United States Patent [19]

Walz

[11] 4,206,576

[45] Jun. 10, 1980

[54] WOOD DESK TOP

[75] Inventor: Fredrick J. Walz, Kentwood, Mich.

[73] Assignee: Steelcase Inc., Grand Rapids, Mich.

[21] Appl. No.: 961,039

[22] Filed: Nov. 16, 1978

[51] Int. Cl.[2] ..... E04G 23/00

[52] U.S. Cl. ..... 52/291; 52/222; 312/194; 108/161; 248/188.2

[58] Field of Search ..... 312/194; 108/161; 52/291, 222, 223 R; 248/346, 678, 188.2

[56] References Cited

U.S. PATENT DOCUMENTS

| | | | |
|---|---|---|---|
| 1,524,897 | 2/1925 | Weil | 52/222 |
| 1,595,398 | 8/1926 | Hoffman | 52/222 |
| 1,701,766 | 2/1929 | Tuomi | 52/291 |
| 2,039,398 | 5/1936 | Dye | 52/223 R |
| 2,425,079 | 8/1947 | Billig | 52/88 |
| 2,479,477 | 8/1949 | Cusano | 248/188.2 |
| 2,856,644 | 10/1958 | Dunham | 52/291 |
| 3,142,136 | 7/1964 | Silberkuhl et al. | 52/223 R |
| 3,471,973 | 10/1969 | Behmlander | 52/291 |
| 3,837,298 | 9/1974 | Leonhart | 108/161 |
| 3,913,293 | 10/1975 | Bischoff, Jr. | 52/222 |

*Primary Examiner*—Victor N. Sakran

*Attorney, Agent, or Firm*—Price, Heneveld, Huizenga & Cooper

[57] ABSTRACT

The specification discloses a desk top in which a prestressing bar having a convex upper surface is located within a groove in the bottom of the desk top. The ends of the bar are biased towards engagement with the upper surface of the groove whereby the desk top itself is biased towards a convex configuration, thereby compensating for forces tending to cause the top to bow downwardly.

19 Claims, 4 Drawing Figures

WOOD DESK TOP

BACKGROUND OF THE INVENTION

The present invention relates to desk tops, particularly desk tops made of wood. There is a tendency for wooden desk tops to sag or bow downwardly after a period of use. This is particularly true with longer tops of from 66–72 inches.

At least one prior artisan has attempted to overcome this problem by employing a pretension device for tensioning the top towards an upwardly bowed condition to thereby offset the downward forces imposed on the top in use. Basically, the prior art device comprises a rod threaded at both ends and located in a groove beneath the desk top such that when nuts on the ends of the rod are tightened down, the rod is placed in tension and the top thereby biased upwardly.

Such a mechanism is costly. So too are other attempts to solve the sag problem by providing costly reinforcement constructions under the top.

SUMMARY OF THE INVENTION

In the present invention, the top sagging problem is solved through the use of an inexpensive bar having a convex upper surface. The bar is located in a groove in the bottom of the desk top and the ends of the bar are biased towards engagement with the upper surface of the groove whereby the entire desk top is biased towards a convex or upwardly bowed condition. If desired, the means biasing the ends of the bar upwardly can be made adjustable whereby the prestress on the desk top can be adjusted.

These and other features, objects and advantages of the present invention can be more fully understood and appreciated by reference to the written specification and appended drawings.

DESCRIPTION OF THE PREFERRED EMBODIMENT

Figure 1:
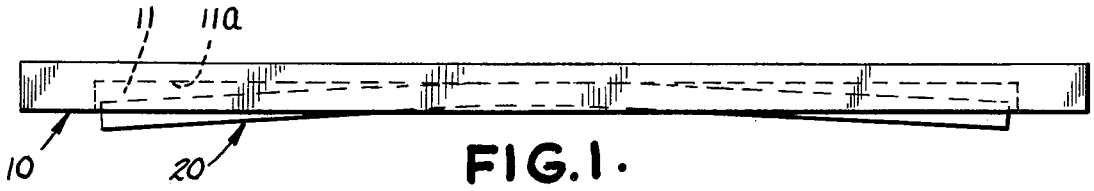
FIG. 1 is a front elevational view of a desk top with a prestressing bar made in accordance with the present invention located within a groove in the undersurface of the top.

In the preferred embodiment, the prestressing bar 20 has a convex upper surface whereas the groove 11 in desk top 10 in which bar 20 is to be located has a generally linear upper surface 11*a* (FIG. 1). When plates 30 are bolted to the underside of desk top 10 over the end portions of bar 20, those ends are biased generally upwardly and desk top 10 is biased towards a bowed condition as illustrated in exaggerated form in FIG. 2.

Figure 2:
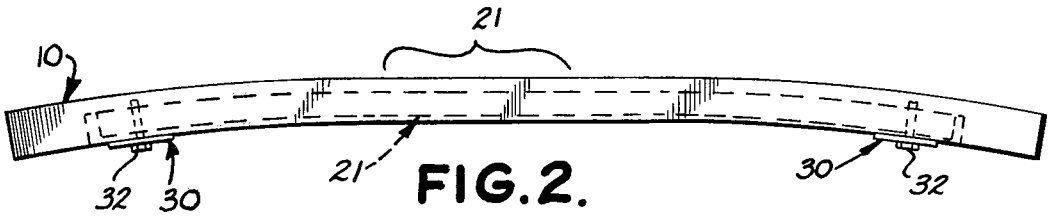
FIG. 2 is the same front elevational view showing the ends of the bar biased upwardly and showing in an exaggerated fashion the curvature which this imparts to the desk top.

Bar 20 is made of a rigid, resilient material such that it will not take a permanent set when it is clamped into position within groove 11. Preferably, bar 20 is made of steel such as 10-8 to 10-95 steel. Naturally, the degree of resilience required depends on the amount of stress which must be placed on bar 20 in order to bias desk top 10 towards a convex configuration as illustrated in FIG. 2. I have found that a steel bar within the range indicated and having a depth from top surface to bottom surface of 1¼ inches and a width from side to side of ¼ inch is satisfactory for most desk tops.

The pitch of bar 20 from the crown to the ends thereof may vary depending on particular applications from about 0.017 to about 0.034. Bar 20 is from about 0.6 to about 0.9 of the length of desk top 10 in which it is to be inserted. For example, in a 72 inch wooden desk top 10, I have found operable a bar which is 44 inches long and a bar which is 68 inches long.

The crown of the upper surface of bar 20 has either a smoothly and gradually curving upper surface (or a generally flat upper surface) so as to create a force distributing surface area 21. This helps prevent the crown of bar 20 from penetrating the material of top 10 and thereby damaging top 10.

Desk top 10 conprises a wooden core with groove 11 routed therein towards the front edge thereof. Groove 11 is approximately 15/16 inches deep to accommodate the depth of bar 20 and is slightly wider than ¼ inch to accommodate the width thereof. The upper surface 11*a* of groove 11 is generally linear and defines generally a tangent of the crown of a bar 20.

Figure 3:
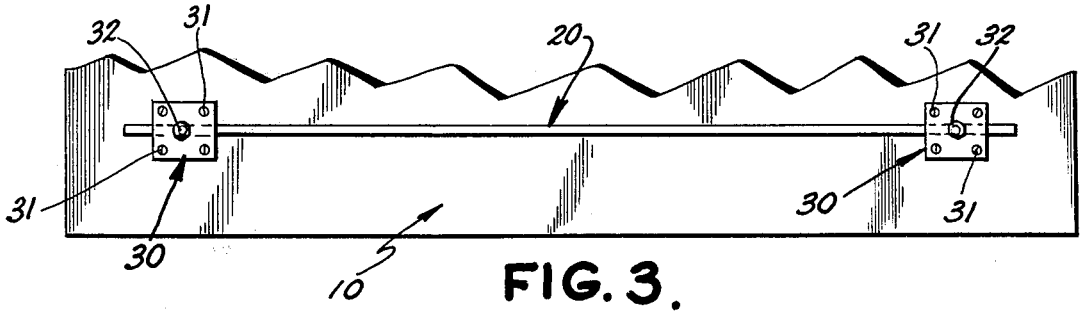
FIG. 3 is a fragmentary bottom plan view showing the bar in position in the desk top.

Mounting plates 30 are preferably small steel squares which are bolted into top 10 near the ends of bar 20 by means of mounting screws 31. If desired, adjustability can be achieved in the system by threading a small set screw 32 through the center of each mounting plate 30 whereby the set screw 32 bears against the bottom of the end portion of bar 20 (FIG. 3). By tightening set screw up, one increases the stress on bar 20. By loosening set screw 32, one decreases the stress in bar 20, and accordingly, the stress in top 10.

Figure 4:
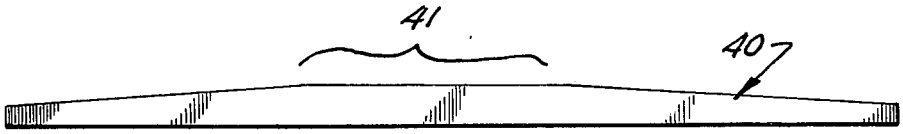
FIG. 4 is a front elevational view of an alternative embodiment bar.

FIG. 4 discloses an alternative embodiment stressing bar 40. Like bar 21, its upper surface is generally convex in configuration. However, its bottom surface is linear rather than curved as is bar 20. The difference is that bar 40 has to be machined to the configuration indicated whereas bar 20 is made by simply taking a linear bar and subjecting it to a bending force. Naturally, the force required to create the bend in bar 20 is considerably greater than the force to which it is subjected when it is in its working position within desk top 10.

Further, the force distributing surface 41 at the crown of bar 41 is generally linear, rather than being gradually curved. In use, bar 40 would be placed in groove 11 of desk top 10 and the bottom of the end portions of bar 40 would be forced upwardly into groove 11 by means of the set screws 32 in mounting plates 31.

Through the use of either prestress bar 20 or prestress bar 40, one biases desk top 10 towards a slightly upwardly bowed configuration. When top 10 is then mounted in a desk, it flattens out. When it leaves the factory, it will either be flat or just slightly bowed upwardly. In the latter case, it will tend to sag towards a perfectly flat condition after it has been used for awhile. If the adjustable set screws 32 are employed, the stress can be adjusted upwardly or downwardly after the desk has been used to insure that top 10 will always be level and linear. Of course, it is understood that the above are merely preferred embodiments of the invention and that various changes and alterations can be made without departing from the spirit and broader aspects of the invention as set forth in the appended claims as interpreted in light of the prior art and in accordance with the doctrine of equivalents.

The embodiments of the invention in which an exclusive property or privilege is claimed are defined as follows.

1. In a desk top assembly including a top and a top prestressing device, the improvement comprising: said prestressing device comprising a bar made of a substantially rigid material having a certain degree of resiliency and having an upper surface which from one end of the bar to the other is slightly convex to define a crown generally at the central portion of the bar; said top including a groove in its bottom surface, said groove being at least as long and as wide as said bar and having an upper surface which is generally linear such that when said crown of said bar is abutting said upper surface of said groove, with said bar under no stress, the upper surfaces of the end portions of said bar are spaced from said upper surface of said groove; said bar being located in said groove with said crown abutting said upper surface of said groove; means biasing said end portions of said bar and said upper surface of said groove towards abutment with one another to thereby bias said top towards a convex configuration.

2. The desk top of claim 1 in which the upper surface of said crown of said bar is shaped to define a force distributing surface area to prevent said crown from penetrating into that portion of said top which is located above said groove upper surface.

3. The desk top assembly of claim 2 in which the pitch of said bar from said crown to said ends thereof is from about 0.017 to about 0.034.

4. The desk top assembly of claim 3 in which said bar is from about 0.6 to about 0.9 of the length of said top.

5. The desk top assembly of claim 4 in which said means biasing said ends of said bar upwardly towards engagement with the upper surface of said groove are adjustable whereby the stress imposed between said bar and said desk top can be adjusted.

6. The desk top assembly of claim 5 in which said means biasing said ends of said bar upwardly comprises a plate bolted to said top against the bottom surface of each end portion of said bar.

7. The desk top assembly of claim 6 in which said biasing means are made adjustable by a threaded screw located in said plate which bears against the bottom of each end portion of said bar.

8. The desk top assembly of claim 4 in which said bar is a linear bar which has been bent generally in the middle thereof to create a convex configuration.

9. The desk top assembly of claim 8 in which said bar is approximately 1¼ inches deep and approximately ¼ inch wide.

10. The desk top assembly of claim 9 in which said bar is made of from 10-8 to 10-95 steel.

11. The desk top assembly of claim 1 in which the pitch of said bar from said crown to said ends thereof is from about 0.017 to about 0.034.

12. The desk top assembly of claim 11 in which said bar is from about 0.6 to about 0.9 of the length of said top.

13. The desk top assembly of claim 1 in which said means biasing said ends of said bar upwardly towards engagement with the upper surface of said groove are adjustable whereby the stress imposed between said bar and said desk top can be adjusted.

14. The desk top assembly of claim 1 in which said means biasing said ends of said bar upwardly comprises a plate bolted to said top against the bottom surface of each end portion of said bar.

15. The desk top assembly of claim 14 in which said biasing means are made adjustable by a threaded screw located in said plate which bears against the bottom of each end portion of said bar.

16. The desk top assembly of claim 1 in which said bar is a linear bar which has been bent generally in the middle thereof to create a convex configuration.

17. The desk top assembly of claim 16 in which said bar is approximately 1¼ inches deep and approximately ¼ inch wide.

18. The desk top assembly of claim 17 in which said bar is made of from 10-8 to 10-95 steel.

19. The desk top assembly of claim 1 in which said bar is made of from 10-8 to 10-95 steel.

* * * * *